United States Patent [19]

Dreisinger et al.

[11] 4,233,844

[45] Nov. 18, 1980

[54] WHEELCHAIR ERGOMETER

[75] Inventors: Thomas E. Dreisinger, Moberly; William L. Carson, Columbia, both of Mo.

[73] Assignee: Cardrei Corporation, Moberly, Mo.

[21] Appl. No.: 971,891

[22] Filed: Dec. 21, 1978

[51] Int. Cl.[3] ..... G01L 5/02

[52] U.S. Cl. ..... 73/379; 272/DIG. 6

[58] Field of Search ..... 73/379, 135; 272/DIG. 6

[56] References Cited

U.S. PATENT DOCUMENTS

| | | | |
|---|---|---|---|
| 3,103,357 | 9/1963 | Berne | 73/379 X |
| 3,572,700 | 3/1971 | Mastropaolo | 73/379 X |
| 3,744,480 | 7/1973 | Gause et al. | 73/379 X |
| 3,784,194 | 1/1974 | Perrine | 272/DIG. 6 X |
| 3,845,756 | 11/1974 | Olsson | 73/379 X |

FOREIGN PATENT DOCUMENTS 2424015 11/1975 Fed. Rep. of Germany ..... 73/379

OTHER PUBLICATIONS

Publication: "An Ergonomic Analysis of Wheelchairs", R. L. Brauer, University of Illinois, Urbana-Champaign, 1972.

*Primary Examiner*—Daniel M. Yasich

*Attorney, Agent, or Firm*—Rogers, Eilers & Howell

[57] ABSTRACT

A wheelchair ergometer provides for the stationary exercise of a subject in a wheelchair and includes a wheelchair mounted on a support with the driving wheels mounted on an elongated central shaft. A set of flywheels is mounted at either end of the central shaft and has provision for mounting weights corresponding to the weight of the subject. The flywheels load the central shaft and simulate the translational inertia present in a moving wheelchair. A torque platform is supported by bearings from the central shaft and is coupled to a friction type brake which may be selectively tightened about the central shaft to cause the brake and platform to deflect in relation to the torque applied to the central shaft. A scale fixedly mounted adjacent the torque platform measures the deflection to indicate the torque on the shaft. A magnetic disc type speedometer and a magnet and reed switch type odometer measure the speed and distance traveled; which permit the calculation of energy the subject supplies to the ergometer during an exercise bout.

22 Claims, 20 Drawing Figures

FIG. 11.
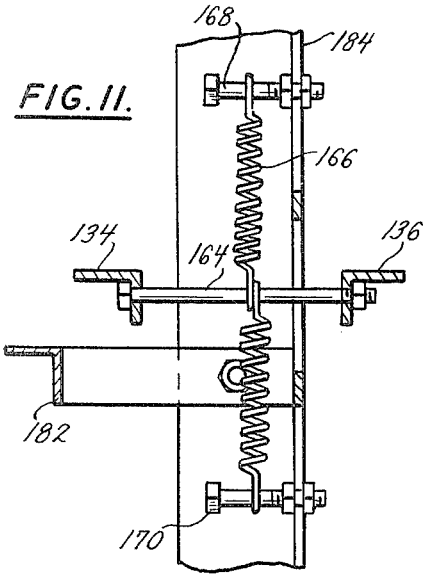
FIG. 12.
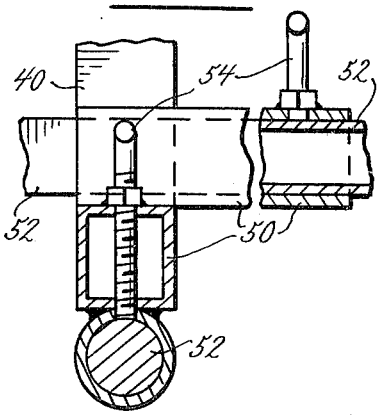
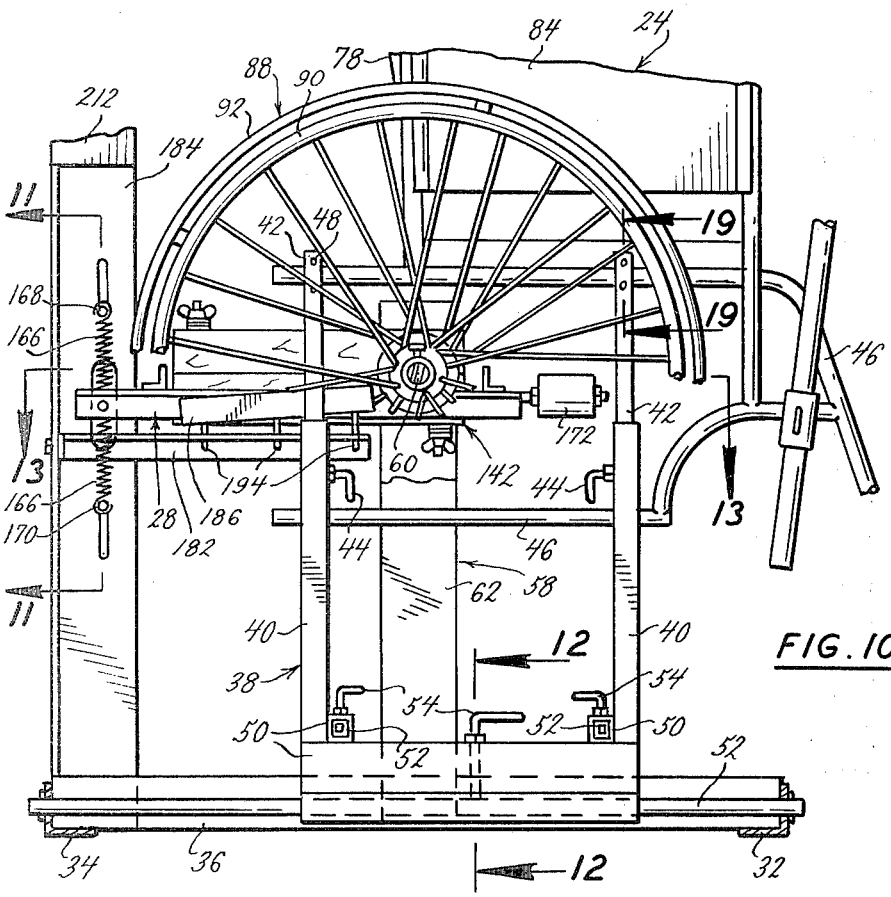
FIG. 10.

15
14

16
17
20

WHEELCHAIR ERGOMETER

BACKGROUND AND SUMMARY

Most of the studies conducted in the area of physical training programs for the handicapped have concluded that there is little benefit to a systematic training program in improving the physical condition of the handicapped. As a result, there has been little work done to develop and improve physical exercise equipment available for the handicapped. Indeed, much of the equipment presently available was developed for use in studies and most designs are of limited complexity, possibly owing to the limited budgets of the studies. In the prior art, there are three types of designs which are prevalent. These include a floor mounted, motor driven treadmill which provides a moving surface over which a wheelchair may be driven by a subject, a platform having rollers which receives the wheels of the wheelchair, and a stationary wheelchair with a chain drive coupling to a bicycle ergometer. Each of these exercise devices are designed to enable a subject to remain stationary as he exercises so that proper instrumentation may be attached to the subject and data collected with a minimum amount of expense and with maximum accuracy and convenience to the experimenter. As can be appreciated, it would be very difficult to perform any sort of extended testing of a subject in a wheelchair if the wheelchair does not remain stationary relative to the instrumentation.

Each of the prior art devices has drawbacks which limit their usefulness and effectiveness as a tool in collecting data and in providing a suitable exercising device. For example, the floor mounted, motor driven treadmill does provide for use of a standard wheelchair but it can be quite expensive to install and maintain and provides a possibility of mishap should the subject either fail to keep up with the treadmill or unexpectedly leave the treadmill during an experiment or exercise bout if no restraining chains were provided. Also, the energy which the individual supplies during exercise is not measurable with the treadmill. The stationary wheelchair coupled with a chain drive to a bicycle ergometer provides a less expensive arrangement than the floor level treadmill but is not suited for accurate energy expenditure measurements due to unmeasurable energy losses involved in the gearing, bearings, and chain drive mechanism. Furthermore, there is no structure provided to compensate for the different effects of translational inertia corresponding to different mass subjects in the wheelchair.

Another prior art device is the wheelchair dynamometer; a platform having rollers which receive the wheels of the wheelchair. A brake and clutch may be mounted on the same shaft as the rollers and provide for loading the rollers, as desired, to simulate either an uphill or downhill surface, wind, terrain, etc. load. Flywheels may be added to the rollers to compensate for the translational inertia loading a subject experiences as he propels his wheelchair. A dynamometer similar to that described was constructed and used by Breur in several studies. He used cast iron, flat belt pulleys as rollers with a magnetic clutch and brake, and a variable weight flywheel connected to the rear of each pair of rollers by a drive chain. The front roller of each pair acts as an idler and provides the seating for the large drive wheels of the wheelchair. Variable weights can be added to the flywheel to compensate for the effects of different mass subjects. The brake is used to simulate non-inertial forces acting on the wheelchair. The dynamometer platform itself is not an accurate means of measuring the energy supplied by the subject since energy losses due to wheelchair bearings and wheel-roller friction are unaccounted for and thus a subject is actually performing greater work than given credit for in the data collected. As can be appreciated, Breur's device is relatively expensive and depends upon a continuous contact between the large wheels of the wheelchair and the rollers to obtain accurate results. Also, it is necessary to wheel the wheelchair and subject up an incline and into position on the rollers before measurements can be made. Also, each time a subject applies a force to the driving wheels, the tires of the wheelchair have a tendency to slip (particularly for heavy brake loads) due to the abrupt application of a torque, which increases the inaccuracy of any energy measurement.

To overcome these and other problems, applicants have succeeded in designing and constructing a stationary wheelchair ergometer which simulates the propulsion of a wheelchair and which eliminates the problems in the prior art devices and provides for more accurate measurement of the actual work expended by a subject during an exercise bout. The wheelchair ergometer simulates the propulsion of a wheelchair by having a stand or the like which elevates a chair and drive wheels above the ground so that a subject may sit in the chair and push the drive wheels as if he were propelling a standard wheelchair. Applicants' device eliminates the friction drive, gearing, and the chain coupling or other driving connections required in the prior art between the central shaft of the wheelchair and various types of loading structure. Applicants' device essentially includes a friction type brake which is clamped to the central shaft of a wheelchair and is also attached to a torque platform which pivots or deflects in relation to the amount of load torque applied to the central shaft. Flywheels are provided at the outer ends of the central shaft and are loaded with weights to compensate for the translational inertia of a rolling wheelchair and subject. A speedometer hook up and revolution counter is provided which measures the speed of the shaft and the distance traveled during exercise bouts which provides sufficient information from which to calculate the energy expended by a subject and also monitor the rate of performance.

Applicants' device is an elegantly simple self contained unit which eliminates much of the heavy expensive structure required in the prior art devices and which also improves the accuracy of subject energy expenditure measurements. Ball bearings and needle bearings support the torque measuring platform from the frame which under steady state operating conditions does not rotate; thus minimizing error in measuring all other torques (i.e. brake and wheelchair bearing torques) which convert the energy supplied by the subject to measurable energy. This bearing support effectively isolates the torque platform from the frame and also minimizes error for those measurements and exercise routines utilizing a moving torque platform. This helps ensure that a subject is credited for all the energy supplied in performing an exercise bout. Furthermore, torque is measured before it has been transmitted through a series of gears of chain drives as in the prior art. Other features include a counterbalance and tilting scale for calibration of torque readout, magnetic pickups to measure speed and count the number of revolutions, and a unique flywheel compensation system to apply an equivalent translational inertia to the wheelchair.

Applicants' wheelchair ergometer has been used in a study with results indicating that wheelchair confined subjects may be substantially benefitted by regular exercise to improve their physical conditioning. It is anticipated that other studies will confirm these results and that there will be a great demand for applicants' wheelchair ergometer for use as an exercise device, as well as for instrumentation in further experiments. These and other features of applicants' invention may be more fully understood by referring to the drawings and description of the preferred embodiment.

BRIEF DESCRIPTION OF THE DRAWINGS

FIG. 10 is an enlarged broken cross-sectional view taken along the plane of line 10—10 in FIG. 2 detailing the torque platform and associated structure;

FIG. 11 is an enlarged cross-sectional view taken along the plane of line 11—11 in FIG. 10 and detailing the travel limiting springs;

FIG. 12 is an enlarged broken cross-sectional view taken along the plane of line 12—12 in FIG. 10 and detailing a section of the support frame;

DETAILED DESCRIPTION OF THE PREFERRED EMBODIMENT

Figure 1:
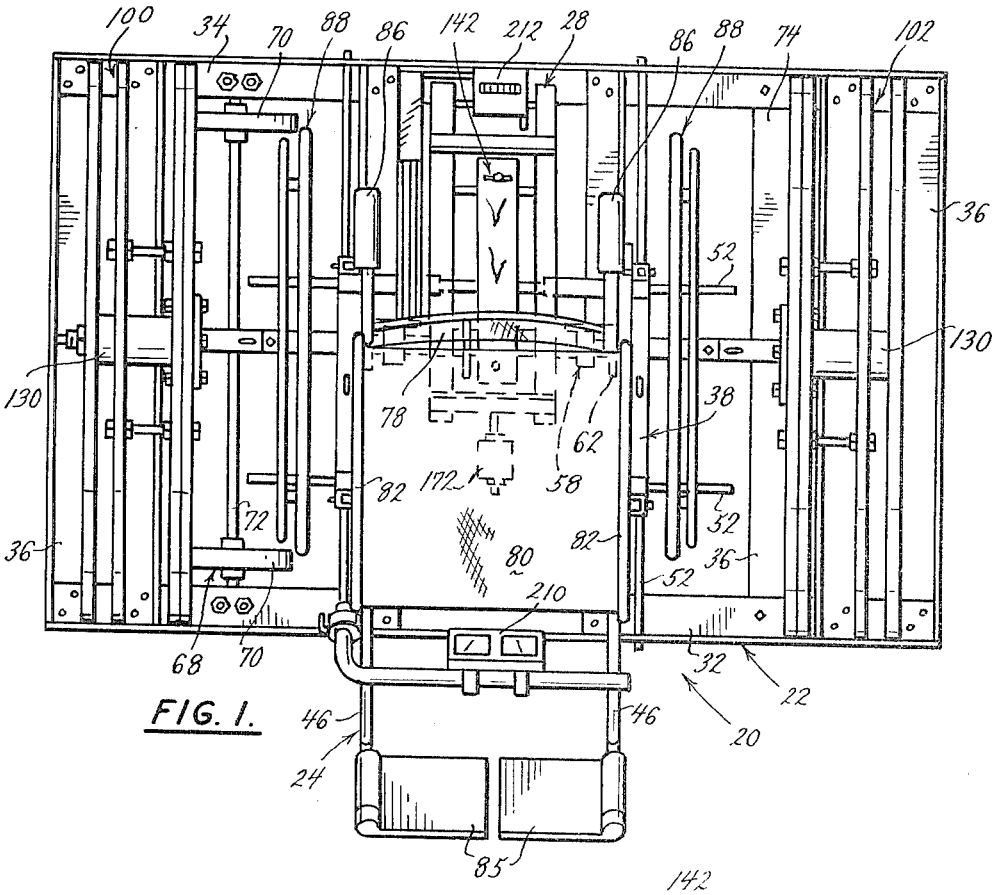
FIG. 1 is an overhead view of the wheelchair ergometer.

Applicants' wheelchair ergometer 20 includes a support frame 22 and wheelchair 24 as is best shown in FIGS. 1, 2, 3, 4, 5, 10 and 12; a flywheel inertia compensation system 26 as is best shown in FIGS. 6, 7, 8, and 9; a torque platform 28 as is best shown in FIGS. 11, 13, 14 and 15; and instrumentation 30 for measuring speed, torque, and distance as is best shown in FIGS. 15, 16, 17, 18, 19, and 20. Each of these subsystems of applicants' wheelchair ergometer 20 will be first described in detail and it will be further explained how these systems interact to achieve the desired purpose of both exercising and measuring energy.

Support Frame and Wheelchair

Figures 2, 3, 4, 5:
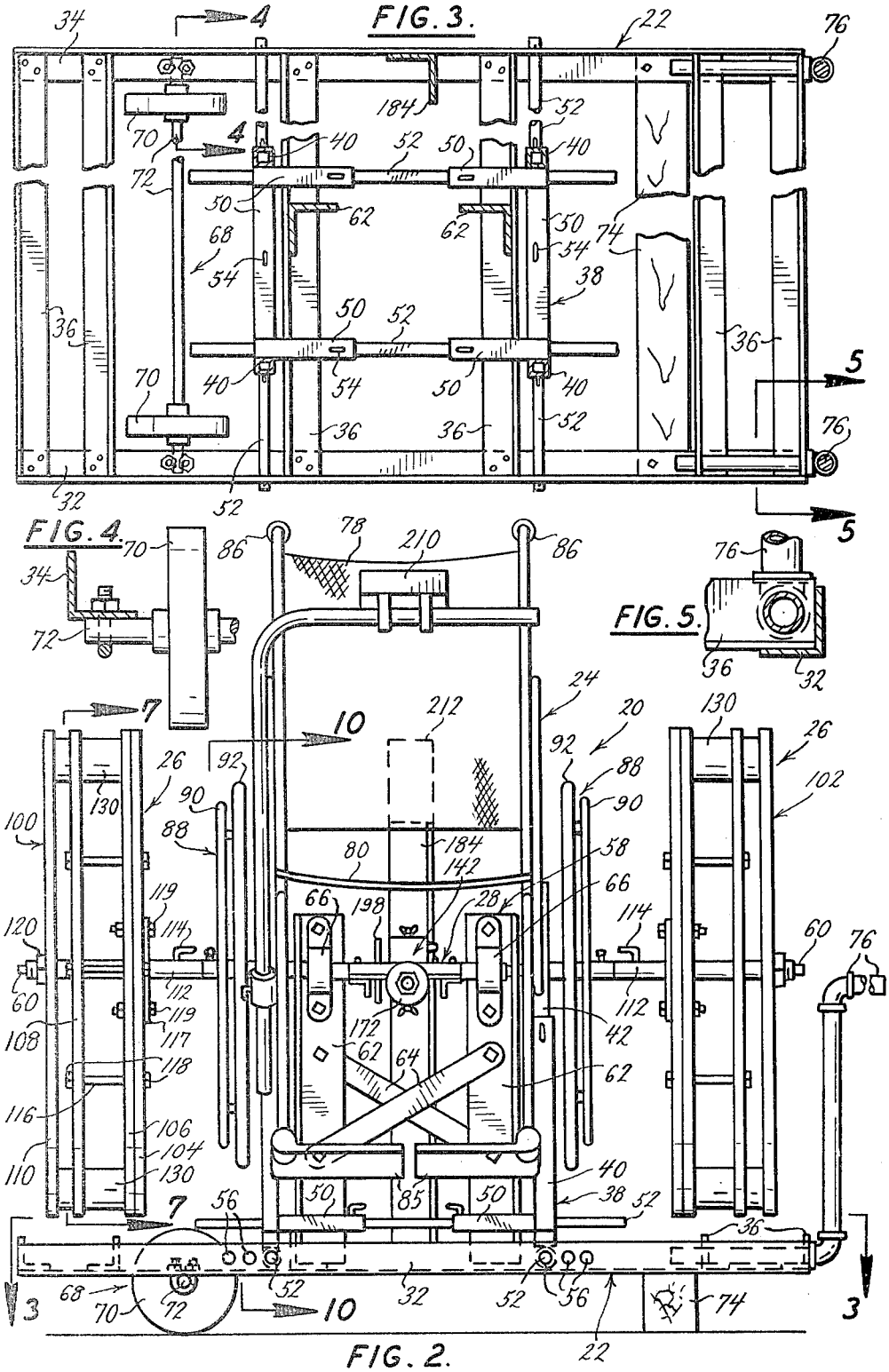
FIG. 2 is a front elevational view of the wheelchair ergometer.
FIG. 3 is a broken cross-sectional view taken along the plane of line 3—3 in FIG. 2 which details the supporting frame.
FIG. 4 is an enlarged cross-sectional view taken along the plane of line 4—4 in FIG. 3 detailing the wheels for the support frame.
FIG. 5 is an enlarged cross-sectional view taken along the plane of line 5—5 in FIG. 3 detailing the lifting handles of the support frame.
Figures 14, 15, 16, 18, 19, 20:
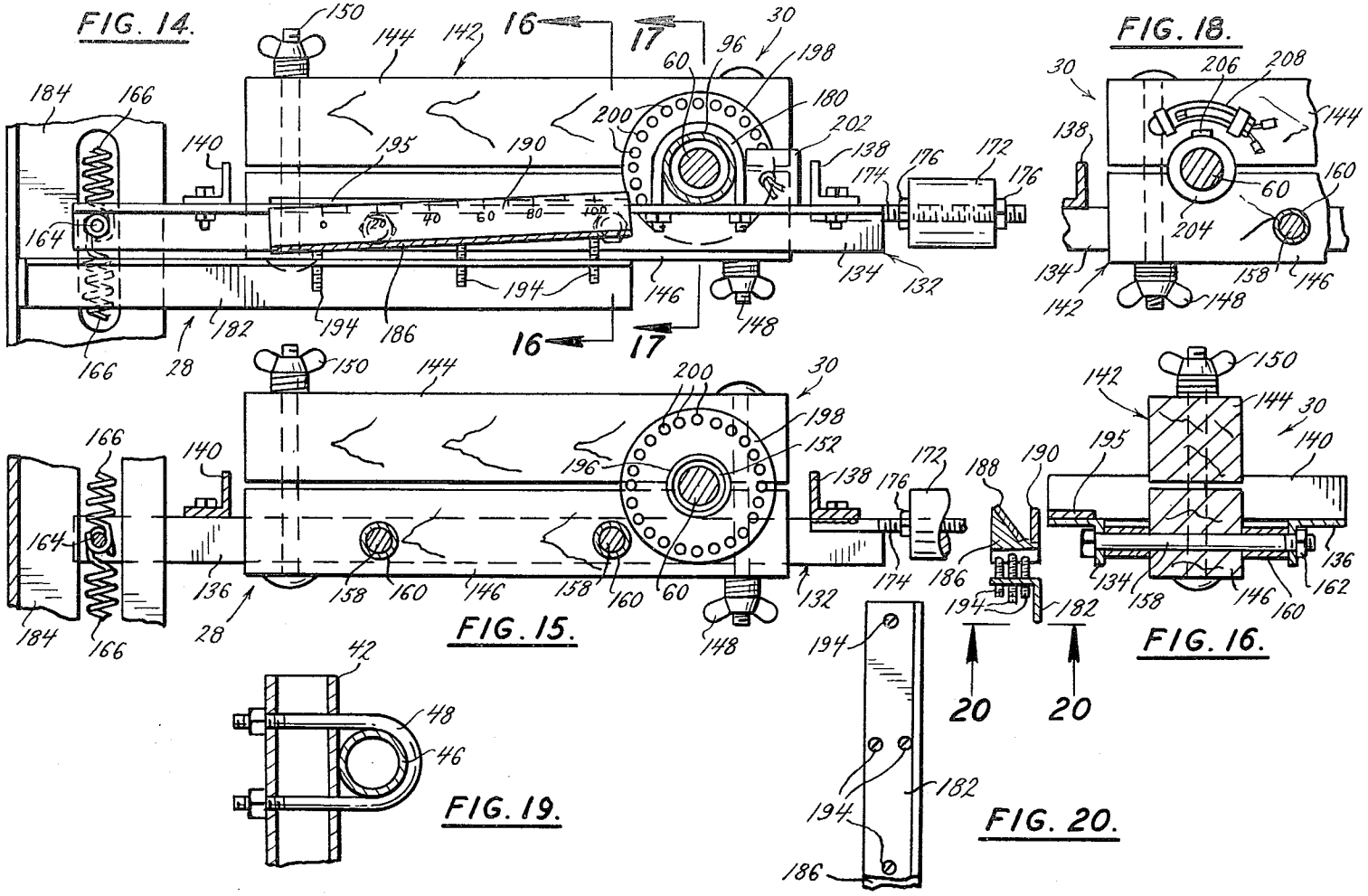
FIG. 14 is an enlarged cross-sectional view taken along the plane of line 14—14 in FIG. 13 and detailing a side view of the brake platform and assembly.
FIG. 15 is a broken cross-sectional view taken along the plane of line 15—15 in FIG. 13 and further detailing the brake assembly.
FIG. 16 is an enlarged broken cross-sectional view taken along the plane of line 16—16 in FIG. 14 and detailing the wooden block brake mounting.
FIG. 18 is an enlarged broken cross-sectional view taken along the plane of line 18—18 in FIG. 17 and detailing the magnetic pickup for the odometer.
FIG. 19 is an enlarged cross-sectional view taken along the plane of line 19—19 in FIG. 10 and detailing the U-clamp mounting of the wheelchair to the support frame.
FIG. 20 is an enlarged view taken along the plane of line 20—20 in FIG. 16 and detailing the calibration structure for the torque scale.

The support frame 22 is best shown in FIG. 3, and includes a front main rail 32 and rear main rail 34. Between these main rails 32, 34, there are six cross rails 36 which are either bolted or welded to main rails 32, 34 and provide a rigid platform capable of withstanding substantial weight and stress as may be experienced in an exercise routine. Both the main rails 32, 34 and cross rails 36 may be fashioned of a suitable gauge of angle iron or the like to provide a solid supporting structure. As shown in FIGS. 2, 3, 6, and 10, a main frame 38 is mounted to and extends upwardly from the rail assembly to support the wheelchair 24 and the other associated structure of the wheelchair ergometer 20. This main frame 38 is adjustable to provide for movement of the wheelchair 24 fore and aft, side to side, up and down, and an adjustable width to accommodate different subjects and different structures of wheelchairs 24. Main frame 38 includes four upstanding post assemblies 40 with telescoping pipes 42 which are held in position by screw-downs 44. The superstructure 46 of wheelchair 24 is clamped to telescoping pipes 42 by U-clamps 48 as is best shown in FIG. 19. The upstanding post assemblies 40 are supported in the main frame 38 by U-shaped frame members 50 which slide over support rails 52 in both the fore and aft and side to side directions. Screw-downs 54 are provided to secure the U-shaped frame members 50 to support rails 52. A series of holes 56 are provided in both the front and rear main rails 32, 34 to accommodate movement of the main frame 38 from side to side and also provide for a change in the width between upstanding post assemblies 40. Thus, main frame 38 may be adapted for use with chairs having lesser or greater widths than normal and also may be used to adjust the position of the wheelchair 24 fore and aft, side to side, and up and down, within the support frame 22 of the ergometer 20. This is best shown in FIG. 3.

A center shaft frame 58 is provided to support the center shaft 60 directly from the support frame 22 and is of substantially heavier construction than the rest of support frame 22. Two angle irons 62 are preferably bolted to the center cross rails 36 and extend upwardly therefrom. A pair of cross beams 64 are bolted between the upstanding angle irons 62 to minimize relative movement between them. Center shaft 60 is supported near the top end of each angle iron 62 by bearings 66, as is more fully explained hereinafter. This structure as described is best shown in FIG. 2 of the drawings.

Structure is provided to enable one to quickly and easily reposition applicants' wheelchair ergometer 20, as desired. As shown in FIG. 2, a wheel assembly 68 including two wheels 70, and an axle 72 extends between the front and rear main rails 32, 34 and are sufficiently strong to withstand the full weight of the wheelchair ergometer 20. At the other end of support frame 22 is a set down block 74 which holds the wheelchair ergometer 20 in place and prevents it from rolling away from its intended position. Set down block 74 extends between front and rear main rails 32, 34. Lifting handles 76 are provided at both the front and rear main rails 32, 34 to lift the support frame 22 and set down block 74 off the ground and wheel the wheelchair ergometer 20 around much as a wheel barrel or other similar device. FIG. 5 details the mounting of lifting handle 76 to main rails 32, 34. FIG. 4 details the wheel 70 and axle 72 mounting to main rails 32, 34.

Figure 17:
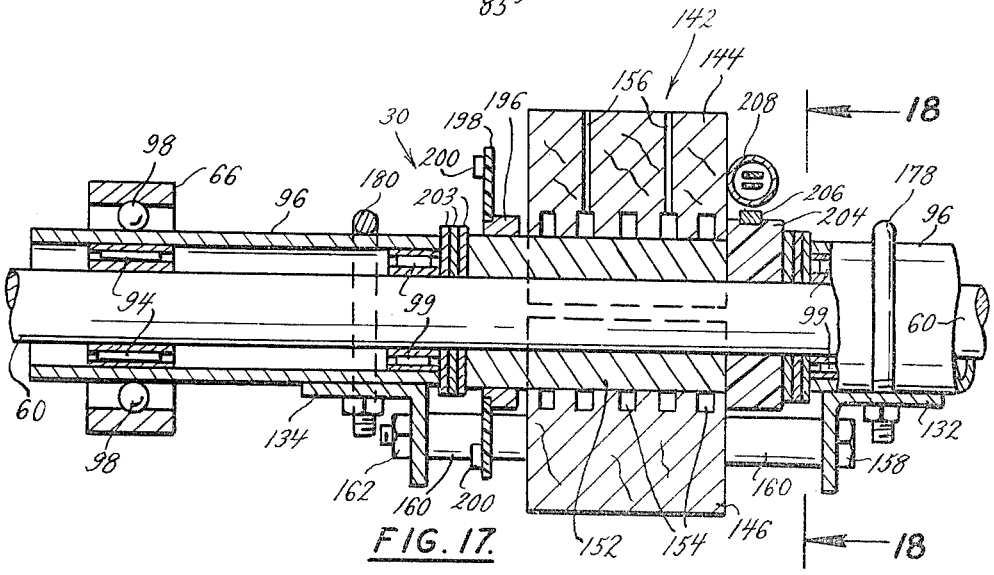
FIG. 17 is an enlarged cross-sectional view taken along the plane of line 17—17 in FIG. 14 and detailing the mounting of the wooden block brake.
Figure 6:
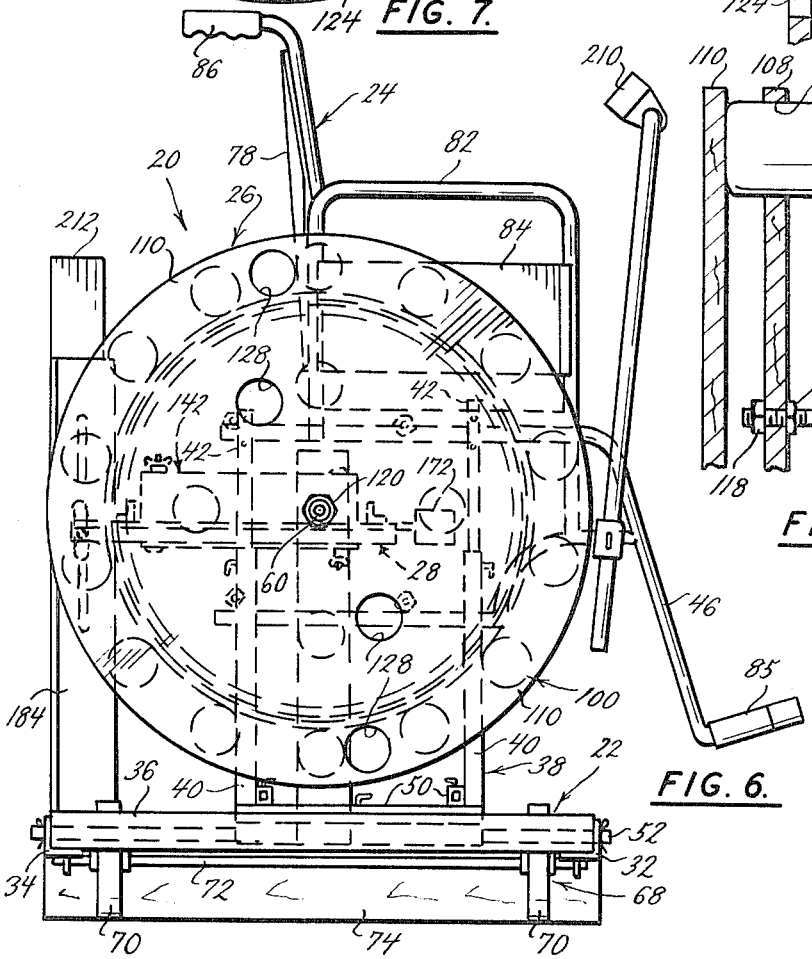
FIG. 6 is an end view of the wheelchair ergometer.

The wheelchair 24, as is best shown in FIGS. 1, 2, and 6, includes a superstructure 46 constructed of hollow steel tubing or the like, a back panel 78, a seat 80, arm supports 82, side panels 84, and foot rests 85. The wheelchair 24 corresponds to the chair means as recited in the claims. Push handles 86 may be provided near the top of the superstructure 46, as is common. Drive wheels 88 are provided on either side of wheelchair 24 to enable a subject to apply a force to shaft 60 and include a hand wheel 90 and a rubber treaded ground wheel 92, as is common. The drive wheels 80 correspond to the means secured to the central shaft to permit a subject to apply a force thereto, as recited in the claims. However, center shaft 60 is provided in place of the usual center axle and is substantially longer and stronger. Also, bearings 66 support the center shaft 60 from center shaft frame 58 instead of the superstructure 46 of wheelchair 24. Bearings 66, as best shown in FIG. 17, include two sets of roller bearings 94, 99 which support center shaft 60 from a collar 96 and ball bearings 98 support the collar 96 from center shaft frame 58. Thus, collar 96 is isolated both from center shaft 60 and center shaft frame 58 and is free to rotate relative to either. This is important as described later in connection with the torque platform 28.

Flywheel Compensation System

The flywheel compensation system is best shown in FIGS. 2, 6, 7, 8, and 9. Referring to FIG. 2, it can be seen that flywheel compensation system 26 consists of a series of flywheels 100 on the right hand side of center shaft 60 and a second series or set of flywheels 102 on the opposite side thereof. As one set of flywheels 100 is the same as the other set of flywheels 102, only one set of flywheels will be more specifically described. However, it is to be understood that both sets of flywheels 100, 102 are provided and operate substantially in the same manner.

Figure 7:
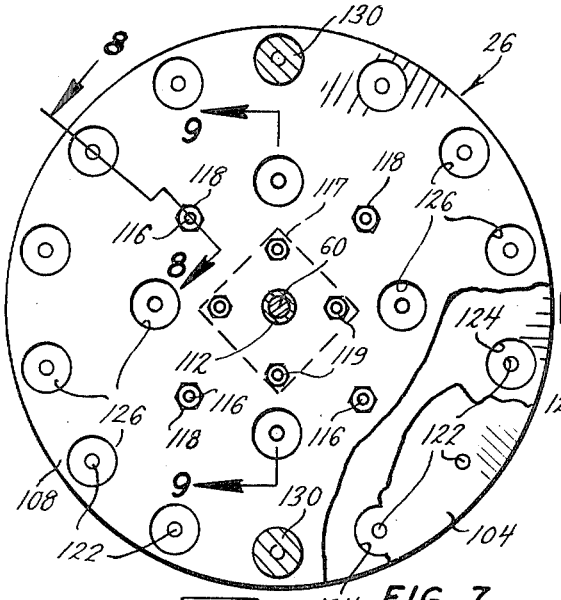
FIG. 7 is a detail view of a set of flywheels, partially broken away to show the can mounting holes.
Figure 9:
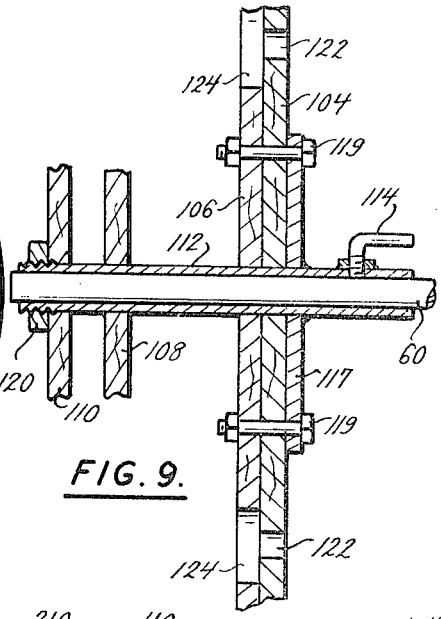
FIG. 9 is an enlarged broken cross-sectional view taken along the plane of line 9—9 in FIG. 7 detailing the construction of the flywheels.
Figure 8:
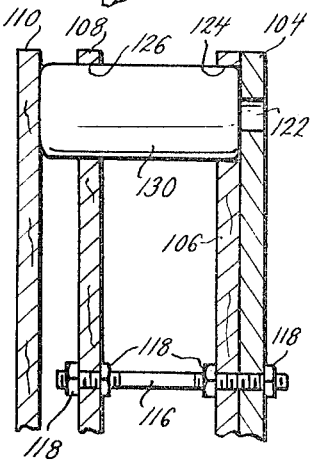
FIG. 8 is an enlarged broken cross-sectional view taken along the plane of line 8—8 in FIG. 7 detailing the mounting arrangement for the flywheel weights.

Flywheels 100 include two inner discs 104, 106, a third disc 108 spaced substantially apart from inner discs 104, 106 and a fourth disc 110 spaced still further away. The set of flywheels 100 is held in this spaced apart relationship by collar 112 with its associated screw-down 114, a series of bolts 116 and nuts 118 as is best shown in FIGS. 7, 8, and 9, and a central nut 120. In addition, a fastening plate 117 and four nut and bolt assemblies 119 held hold inner disc 104, 106 together. It is believed that this structure is easily understood and will not be further explained. Inner disc 104 has a series of small holes 122 along its outer periphery and also around an inner circle substantially equally spaced between the center post 60 and the circumference of inner disc 104. Inner disc 106 has a series of somewhat larger holes 124 which correspond to and match up with small holes 122 both along its outer periphery and along an inner circle. Similarly, third disc 108 has a series of larger holes 126 which match and line up with larger holes 124 and smaller holes 122 of the two inner discs 106 and 104, respectively. The fourth disc, or outer disc 110, has a reduced number of larger holes 128 and it is to be noted that fourth disc 110 may be rotated relative to the first three discs 104, 106, 108. These holes and their positioning is best shown in FIG. 7 which is partially broken away to detail the inner discs 104, 106. A set of weighted cans 130 may be loaded into each set of flywheels 100, 102 at any of the positions corresponding to the holes 124, 126, 128 by rotating the fourth disc 110 so that a hole 128 lines up with the holes 124, 126 of the second and third discs 106 and 108. Then, a can 130 may be slid into position and held in place by third disc 108 and second disc 106. After the desired number of cans 130 have been placed within the set of flywheels 100, the fourth disc 110 may be rotated to partially or fully cover cans 130 and the central nut 120 tightened to secure fourth disc 110 in position. Thus, each set of flywheels 100, 102 may be loaded with as many cans 130 as there are series of holes 124, 126 in disc 106 and 108. Applicants provide 14 holes 124, 126 along the outer periphery and 4 holes 124, 126 along the inner circle. The means to compensate for translational inertia recited in the claims corresponds to the flywheel compensation system 26.

Torque Platform

Figure 13:
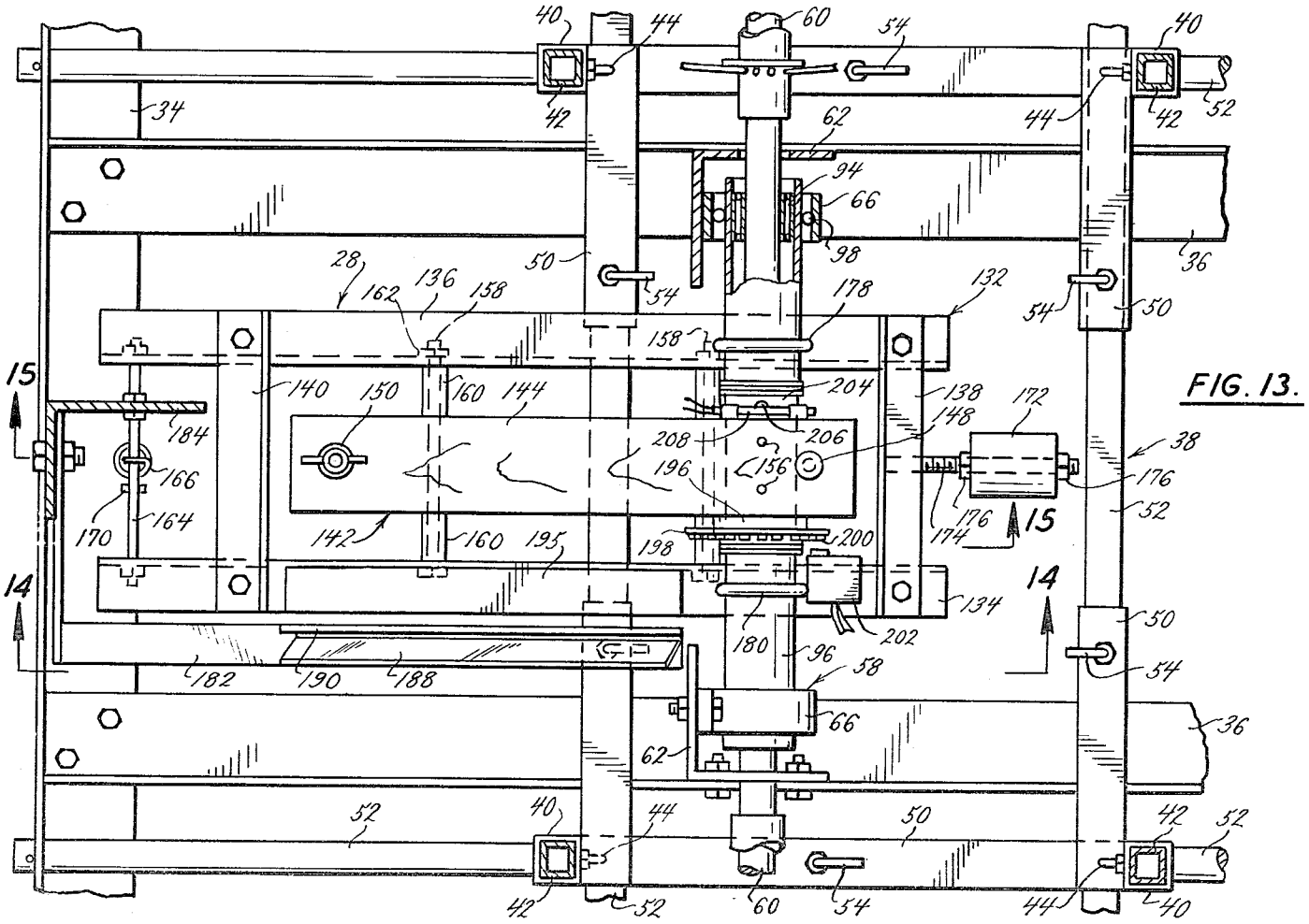
FIG. 13 is an enlarged overhead view taken along the plane of line 13—13 in FIG. 10 and detailing the brake support platform.

The torque platform 28 is best shown in FIGS. 11, 13, 14, and 15, with some further details shown in FIG. 17. Referring to FIG. 13, the torque platform 28 includes a channel frame assembly 132 including main channels 134 and 136 and two interconnecting channels 138, 140 at the front and rear thereof, respectively. As shown in FIG. 17, a friction brake 142 which includes an upper block 144, a lower block 146, a front wing nut assembly 148, and a rear wing nut assembly 150 is secured to a friction collar 152 which is bonded to center shaft 60. Annular grooves 154 are formed in the surface of blocks 144, 146 to surround the point of contact with friction collar 152. Feed lines 156 communicate with and extend upwardly from annular grooves 154 to provide for the introduction of lubricating and cooling fluid along the common surfaces of friction brake 142 and friction collar 152.

Friction brake 142 is secured between main channels 134, 136 with interconnecting bolts 158, spacers 160 and fastening nuts 162. At the rear of torque platform 28, a limiting bolt 164 extends between main channels 134, 136. Travel limiting springs 166 are connected to limiting bolt 164 and extend to mounting posts 168, 170 as is best shown in FIG. 11. Travel limiting springs 166 resist movement of torque platform 28 about center shaft 60 and provide the force to hold the platform 28 in a position of static equilibrium to enable torque readings to be made. Friction brake 142 in combination with the torque platform 28 and springs 166 correspond to the means to apply a braking force directly to the central shaft as recited in the claims.

A counterbalance weight 172 extends forwardly of interconnecting channel 138 and is mounted on a threaded rod 174 and held in place by nuts 176. Counterbalance weight 172 is used to zero the torque readout and adjust the center of gravity of the torque platform so the weight plane of the platform counterweight assembly passes through the center line of shaft 60. Thus, errors in torque measurement due to platform weight are eliminated. This can be best visualized by viewing FIG. 14, remembering that the torque platform 28 is balanced about center shaft 60 on bearings 94, 99.

Main channels 134 and 136 are clamped to collar 96 on either side of friction brake 142 by U-bolts 178 and 180, respectively. Thus, torque platform 28 is clamped to collar 96 which is supported by bearings 94, 99; and friction brake 142 is clamped around friction collar 152 that is fastened to center shaft 60. Friction brake 142 is held in position relative to torque platform 28 by bolt 158, and spacers 160; and travel limiting springs 166 are attached to limiting bolt 164. As will be more fully described hereinafter, as center shaft 60 is caused to rotate, a torque develops between friction brake 142 and friction collar 152 which causes the entire torque platform 28 to deflect in relation to the amount of torque applied therebetween.

Instrumentation

The instrumentation for the wheelchair ergometer 20 is best shown in FIGS. 14, 15, 16, 17, 18 and 20. The structure used to measure the torque is shown generally in FIG. 13 and includes an angle iron support 182 which is bolted to an instrumentation stand 184 which extends upwardly from support frame 22. As shown in cross section in FIG. 16, angle iron support 182 has mounted thereon an adjustable support block 186 which supports a mirror 188 and a scale 190. Support block 186 is adjustable (to zero and set gain of readout) as shown in FIG. 20 by four adjustment screws 194. An indicator 195 comprising a flat black length of wood with a polished metal edge imbedded thereon or the like is mounted to main channel 134 and extends the same length as scale 190. Thus, as torque platform 28 rotates upward in response to a torque applied to center shaft 60, indicator 195 also rotates upward and intersects the top of scale 190 at the appropriate reading. As is evident, the greater the deflection of torque platform 28, the greater the torque being applied to center shaft 60 and the greater the reading along scale 190. Mirror 188 is angled to provide a convenient device for overhead viewing of the torque reading during operation of the wheelchair ergometer 20. The polished metal edge on the flat black indicator 195 provides a distinct point of intersection with scale 190 as shows up quite well in mirror 188.

Referring to FIG. 17, the speed of center shaft 60 may be determined through use of collar 196 which is bonded to friction collar 152 and has disc 198 extending outwardly therefrom. Permanent magnets 200 are secured to disc 198 along the periphery thereof and a magnetic pickup 202 (as shown in FIGS. 13 and 14) is mounted adjacent to the spinning permanent magnets 200. Thus, as disc 198 and permanent magnets 200 rotate, magnetic pickup 202 produces an output voltage related to the speed at which center 60 is rotating. Spacer washers 203 provide bearing surfaces between disc 198 and collar 96.

The revolutions made by center shaft 60 may be determined with collar 204 having one permanent magnet 206 mounted thereon and a reed switch 208 or the like mounted adjacent thereto. Thus, as center shaft 60 rotates and permanent magnet 206 passes near reed switch 208, a contact closure is made and opened producing a signal pulse for each revolution. This is best shown in FIG. 18 and in cross section in FIG. 17.

As shown in FIGS. 1, 2, and 6, a display 210 is provided immediately in front of the exercise subject to give him an indication of travel speed during his exercise bout. As is best shown in FIG. 1, a counter 212 is provided which measures the total number of revolutions of center shaft 60, and hence, the total distance traveled. The means to measure the force applied to the central shaft corresponds at least in part to the torque platform 28, indicator 195, and scale 190 from which the torque may be determined; disc 198, magnets 200, and magnetic pickup 202 from which the speed may be determined; and magnet 206 and reed switch 208 from which the distance traveled may be determined.

Operation

As can be appreciated from the foregoing description, applicants' wheelchair ergometer 20 provides structure for simulating the translational inertia experienced by a moving subject and wheelchair. This can be easily conceptualized by understanding that once a wheelchair is moving along a flat surface, even though the subject ceases to apply any force to the driving wheels, the chair continues to roll until forces such as the frictional forces within the wheelchair and between the wheelchair and the rolling surface bring it to a halt. This tendency to continue rolling even after a force is no longer being applied is directly attributable to translational inertia.

Drag forces exist which may also be compensated for including the resistance of air, the increased affects of gravity when rolling up an incline, and the like. All of these type forces may be simulated with applicants' stationary wheelchair ergometer 20 through use of the adjustable torque of the friction brake 142.

The flywheel compensation system 26 compensates for inertial type forces by loading the center shaft 60 with a preselected weight at a preselected distance from the center shaft 60 which effectively provides the equivalent amount of kinetic energy to the shaft as would be provided by a subject in a wheelchair of corresponding weight moving at the same speed.

The flywheel compensation system must be calibrated by first determining the equivalent mass moment of inertia. This may be done by suspending the rotating components, counting the number of oscillations of the components for a given period of time, weighing the components, calculating the moment of inertia about the axis of suspension, and then translating it to the axis through the center of the flywheel compensation system. For applicants' flywheel compensation system 26, an equivalent mass moment of inertia of 3.68 foot-pounds-seconds$^2$ was calculated.

The mass moment of inertia of flywheel compensation system 26 provides inertia equivalent to a wheelchair and a 60 pound subject. A can 130 weight of 8½ pounds provides equivalent inertia to an increased subject weight of 20 pounds when two cans 130 are inserted in flywheel 100, each at a radius of 13 inches. Similarly, if two cans 130 each weighing 8½ pounds are inserted in flywheel 100 at a radius of approximately 6.45 inches, the flywheel compensation system 26 provides an equivalent increased translational inertia corresponding to an increase of 5 pounds in the subject's weight. Thus, by using various combinations of holes 124, 126, 128 as is disclosed in applicants' preferred embodiment, the flywheel compensation system 26 can provide inertia equivalent to a subject weighing from 60 to 260 pounds, in increments of 5 pounds. Also, using applicants' scheme of pairs of cans 130, flywheels 100, 102 may always be balanced about center shaft 60 so as to eliminate any unbalanced forces. There is no need to balance the weighted cans 130 in one flywheel 100 to the other flywheel 102.

All of the instrumentation 20 must also be calibrated so as to ensure accurate indications are developed during an exercise bout. The speedometer display 210 may be quickly and easily calibrated by driving the center shaft 60 through drive wheels 88 at a known speed and marking a scale with its corresponding number. This may be repeated for a range of speeds suitable for the user's purposes. Applicants have found that a scale having a range of from zero to five miles per hour is suitable for use furing many of their exercise experiments.

The torque platform 28 must also be balanced and calibrated by using counterbalance weight 172 and scale 190. Counterbalance weight 172 is first adjusted by moving it either further away from or closer to center shaft 60 on its threaded rod 174 and then fixed in position with nuts 176 so as to achieve a balance of the torque platform 28 when no torque is applied to center shaft 60. Adjustment screws 194 are adjusted to position support block 186 to achieve a zero reading on scale 190. A predetermined weight is then suspended from a predetermined distance from center shaft 60 to provide an equivalent torque in inch pounds. The scale 190 is then marked where it intersects with indicator 195 with a torque to correspond with the weight and distance. For example, in applicants' scale 190, a torque of 80 inch pounds was placed on the torque platform 28 and the scale marked accordingly. The scale 190 was then equally divided and marked at intervales of 10 up to 100. In this manner, scale 190 is linear and less subject to reading error. A conversion chart provides a means to convert a scale reading to an equivalent torque. This aids the experimenter in observing and recording accurate readings from the scale as the numbers are equidistant from each other.

A Typical Exercise Routine

As mentioned above, applicants' wheelchair ergometer 20 has been used as instrumentation in experiments with wheelchair confined subjects to determine whether a regular program of exercise improves the conditioning of the subject. A typical exercise routine used during this experiment would include first weighing the subject and adding cans 130 to sets of flywheels 100, 102 to set up the flywheel compensation system 26 and provide for an equivalent translational inertia. The subject is then positioned in the wheelchair 24 and begins the exercise bout by applying a force with his hands, arms and shoulders to the hand wheel 90 and thus spinning drive wheels 88 and center shaft 60. The subject is asked to attain a beginning speed of 3 miles per hour under no load conditions and when he has attained same, the rear wing nut assembly 150 is tightened by the experimenter to attain a reading corresponding to 32 inch pounds, or 37 on the torque platform scale. The subject continues exercising at this loading for a period of 2 minutes. The experimenter then increases the torque by further tightening rear wing nut assembly 150 to attain a scale reading of 62 corresponding to 48 inch pounds of torque. The subject exercises at this level for another 2 minutes. This sequence continues for torques of 64 inch pounds, 80 inch pounds, 96 inch pounds, 112 inch pounds, 128 inch pounds, and 144 inch pounds; or until the subject is unable to exercise further. Throughout the exercise bout, the subject is asked to maintain the speed of the wheelchair at 3 miles per hour and only the torque is varied by tightening rear wing nut assembly 150 to thereby increase the friction of the friction brake 142 about friction collar 152.

Applicants provide a description of this exercise routine as an example only and note that other exercise routines may be designed and used with applicants' wheelchair ergometer 20 to suit the preferences of the user. For example, the torque may be preselected and the subject asked to vary the speed of the wheelchair 24 during an exercise bout. Or, various combinations of changing torque and changing speed may be used. Although the flywheel compensation system 26 is generally intended to provide an equivalent inertial loading on the center shaft, it too may be used to vary the exercise routine and provide another variable which can be utilized in developing data or exercise variations. For example, an experimenter may be interested in data concerning the effects of increased body weight on the energy expended by a subject and in accelerating a wheelchair, all other things being assumed equal.

Various changes and modifications of applicants' invention as described in the preferred embodiment are suggested by applicants and would be obvious to one of ordinary skill in the art. These changes and modifications are included within the teaching of applicants' invention and they intend that their invention be limited only by the scope of the claims appended hereto.

What is claimed is:

1. A device to permit the stationary exercise of a subject by simulating the propulsion of a wheelchair comprising a chair means to support a subject in a sitting position, a support to elevate said chair means and device above its supporting surface, a central shaft rotatably secured to said support, means secured to said shaft to permit said subject to apply a force to said shaft, means to apply a braking force directly to said shaft to thereby resist rotation of said shaft by said subject, means to measure the force applied by the subject to the shaft, and means secured to said central shaft to compensate for translational inertia whereby the subject may simulate the propulsion of a wheelchair by sitting in the chair means and applying a force to the central shaft.

2. The device of claim 1 further comprising means to measure the speed of the shaft.

3. The device of claim 1 wherein the compensation means further comprises means to adjust the compensation to correspond to the weight of a particular subject and wheelchair.

4. The device of claim 1 further comprising means to measure the torque between the brake and the shaft.

5. The device of claim 4 wherein the torque measuring means includes a torque platform secured to said braking means and means to measure the angle said platform pivots as said shaft rotates.

6. The device of claim 1 further comprising means to count the number of revolutions of the shaft.

7. The device of claim 1 wherein the braking means includes a friction type brake clamped around said shaft, and means to vary the amount of braking pressure applied by said brake to said shaft.

8. The device of claim 1 wherein the means to apply a force of said shaft includes a pair of wheelchair drive wheels.

9. A wheelchair ergometer to permit the stationary exercise and measurement of energy supplied by a subject simulating the propulsion of a wheelchair including a support frame, an axle and wheel assembly supporting an end of said frame, a set down block supporting the opposite end of said frame, lifting handles extending upwardly from said opposite end to accommodate the lifting and rolling about of said ergometer on said axle and wheel assembly; a main frame assembly attached to and supported by said support frame, a wheelchair superstructure mounted to and supported by said main frame, said main frame having means to adjust the position of said wheelchair superstructure in both the vertical and horizontal planes including means to accommodate wheelchair superstructures having different widths; a center shaft frame mounted to and supported by said support frame, an elongated center shaft, bearings supporting said center shaft from said center shaft frame, a pair of wheelchair drive wheels mounted on said center shaft on either side of said wheelchair superstructure, a friction collar medially mounted on the center shaft, an adjustable friction brake comprising an upper block and a lower block, said blocks being fastened together and around said friction collar by a front wing nut assembly and a rear wing nut assembly, said wing nut assemblies having means to adjust the friction between said brake and said collar as said center shaft is rotated, a plurality of annular grooves in said blocks surrounding said friction collar with feed lines communicating therewith to permit the application of lubricating and cooling fluid thereto, a torque platform, means connecting said friction brake to said torque platform, a freely rotatable collar mounted on either side of said friction brake, said center shaft bearings having means supporting said freely rotatable collars both from said center shaft and from said center shaft frame, means connecting said torque platform to each of said freely rotatable collars, a counterbalance weight attached to said torque platform with means to balance said torque platform about said center shaft, said torque platform and friction brake deflecting about said center shaft as it is rotated in an amount related to the amount of torque applied to said center shaft, spring means extending between said torque platform and said support frame to resist the movement of said torque platform as it deflects about said center shaft, means to measure the torque applied to said center shaft including a scale secured to said support frame, and an indicator secured to said torque platform so that said indicator and scale measure the deflection of said torque platform about said center shaft, a flywheel compensation system comprising two sets of flywheels, one of said sets mounted at each end of said center shaft, each set comprising four discs including a first inner disc having means defining a plurality of smaller holes around the periphery thereof and a plurality of smaller holes in a smaller circle closer to said center shaft, a second disc fixedly secured to said inner disc and having means defining a plurality of larger holes to match and line up with said smaller holes, a third disc spaced apart from said first and second discs with means retaining said third disc in a fixed relationship to said first and second discs and having means defining a plurality of larger holes to match and line up with those in said first and second discs, and a fourth disc, means to rotate said fourth disc with respect to the said three other discs, said fourth disc having means defining at least one larger hole along the periphery thereof and at least one larger hole along the smaller circle so that said fourth disc may be rotated to line up its holes with any one of said set of holes in said three other discs and also rotated so as not to be lined up therewith, a plurality of weighted cans sized to fit within said sets of holes and be retained therein by said fourth disc, means to measure the speed of said central shaft including a disc having a plurality of magnets mounted around its periphery and mounted on said friction collar, a magnetic pickup spaced adjacent said periphery so that a voltage is induced in said magnetic pickup in relation to the speed of said central shaft, and a display to permit the direct reading of the induced voltage, and means to measure the number of revolutions of said central shaft including a permanent magnet mounted on said friction collar and a reed switch adjacent said magnet so that each time the central shaft rotates through a full revolution, said magnet moves near said reed switch and causes it to operate its contacts, and a counter to record each revolution of said central shaft.

10. A stationary wheelchair ergometer for measuring the energy supplied by a subject in an exercise bout comprising a support, a wheelchair superstructure secured to said support, and elongated central shaft mounted transversely to said wheelchair superstructure and rotatably supported from said support, means to apply a braking torque to said shaft, a torque platform fixedly secured to said braking means, bearing means between said platform and said support so that rotation of said central shaft pivots said torque platform and said braking means, means to measure the angle formed between said torque platform and said support as said shaft is rotated, and means to measure the speed of rotation of said shaft.

11. The device of claim 10 further comprising means to compensate for the translational inertia of said wheelchair and subject including flywheel means secured to said central shaft, and means to add weight to said flywheel means in proportion to the weight of the subject and wheelchair.

12. The device of claim 10 further comprising means to resist movement of the torque platform about the central shaft.

13. The device of claim 10 further comprising means to calibrate the angle measuring means.

14. The device of claim 10 further comprising means to balance the torque platform about the center shaft including an adjustable counterbalance weight.

15. The device of claim 10 further comprising means secured to the central shaft to compensate for translational inertia, said compensation means including at least one flywheel secured to the central shaft, and a plurality of weights, said flywheel having means to mount said weights a predetermined distance from said center shaft.

16. The device of claim 10 further comprising bearing means between the platform and the shaft.

17. The device of claim 10 further comprising means to vary the braking torque applied to said central shaft.

18. The device of claim 10 wherein the braking means includes a friction brake comprised of a split block having an upper and lower portion, an annular collar secured to said central shaft, each of said portions having means for receiving said annular collar, means to clamp said portions about said annular collar, said receiving means being sufficiently sized so that said split block thereby applies a clamping force to said central shaft resisting relative movement therebetween, means to lubricate and cool the point of contact between said split block and said collar including means defining a plurality of annular grooves in said split block and channels extending through said upper portion and communicating with said annular grooves to feed said grooves with lubricating and cooling fluid.

19. The device of claim 10 wherein the torque measuring means includes a first straight edge secured to said support, a second straight edge secured to said torque platform, said first straight edge having a scale so that as said torque platform pivots said second straight edge intersects said scale, and a mirror mounted adjacent said first straight edge to aid in reading said scale from overhead.

20. The device of claim 10 wherein the speed measuring means includes a disc attached to the central shaft, a plurality of magnets mounted on the disc, a magnetic pickup mounted adjacent said disc so that as said disc rotates with the central shaft, said magnets induce a voltage in said magnetic pickup related to the speed of said shaft, and a speedometer electrically connected to said magnetic pickup to provide a visual indication to the subject of the speed of said shaft.

21. The device of claim 10 further comprising means to count the number of revolutions of said central shaft.

22. The device of claim 21 wherein the counting means includes a magnet mounted on the central shaft, a reed switch mounted adjacent said shaft so that said magnet operates said switch as said shaft rotates, and a counter to record said shaft rotations.

* * * * *

UNITED STATES PATENT OFFICE

CERTIFICATE OF CORRECTION

Patent No. 4,233,844 Dated November 18, 1980

Inventor(s) Thomas E. Dreisinger and William L. Carson

It is certified that error appears in the above-identified patent and that said Letters Patent are hereby corrected as shown below:

Column 5, line 17, change "wheel barrel" to --wheelbarrow--;
Column 5, line 31, change "wheels 80" to --wheels 88--;
Column 5, line 67, remove "held" between "119" and "hold".

Column 6, line 49, change "point" to --surface--.

Column 7, line 64, insert --shaft-- between "center" and "60".

Column 9, line 21, change "furing" to --during--;
Column 9, line 40, change "intervales" to --intervals--.

Signed and Sealed this

Nineteenth Day of May 1981

[SEAL]

Attest:

RENE D. TEGTMEYER

Attesting Officer

Acting Commissioner of Patents and Trademarks